United States Patent [19]

Cort et al.

[11] 3,990,855

[45] Nov. 9, 1976

[54] CLOG PREVENTING DEVICE FOR AIR CONDITIONING CONDENSATE DRAIN PANS

[75] Inventors: J. George Cort, Port Washington; Ernest Chanes, New York, both of N.Y.

[73] Assignee: CDC Chemical Corporation, New York, N.Y.

[22] Filed: Sept. 20, 1974

[21] Appl. No.: 508,028

[52] U.S. Cl. ..... 23/267 E; 137/268; 210/169; 4/228

[51] Int. Cl.[2] ..... B01F 1/00

[58] Field of Search ..... 222/54, 184–185, 222/187, 190, 565; 23/267 E, 267 A; 4/222, 228; 21/107; 210/169; 137/268

[56] References Cited

UNITED STATES PATENTS

| | | | |
|---|---|---|---|
| 3,094,134 | 6/1963 | Currie | 23/267 E |
| 3,190,726 | 6/1965 | Rudelick | 23/267 E |
| 3,290,698 | 12/1966 | Joyner et al. | 4/228 |
| 3,604,020 | 9/1971 | Moisa | 4/228 |
| 3,615,244 | 10/1971 | Long et al. | 23/267 E X |
| 3,869,069 | 3/1975 | Levey et al. | 4/228 X |

FOREIGN PATENTS OR APPLICATIONS

| | | | |
|---|---|---|---|
| 2,477 | 2/1891 | United Kingdom | 222/565 |
| 705,904 | 3/1954 | United Kingdom | 4/228 |
| 916,652 | 1/1963 | United Kingdom | 4/228 |

*Primary Examiner*—Robert B. Reeves
*Assistant Examiner*—Charles A. Marmor
*Attorney, Agent, or Firm*—Blum, Moscovitz, Friedman & Kaplan

[57] ABSTRACT

A unit for prevention clogging in condensate drain pans by discharging an anti-bacterial chemical into the drain pan to prevent slime accumulation is provided. The anti-bacterial chemical comprises of a first low-soluble anti-bacterial compound and a second readily soluble compound having a higher solubility that the first low soluble anti-bacterial compound. The device is provided with a novel cap having metering orifices for effecting a controlled diffusion rate of anti-bacterial chemicals into a drain pan and further including projections for spacing the metering orifices away from a surface, the spacing in combination with the metering orifices and solubility characteristic of the anti-bacterial chemical effecting a capillary action to introduce the anti-bacterial chemical through the orifice into contact with the condensate at a controlled rate. The cap is adapted to be secured to a container having anti-bacterial chemicals therein, the cap further including a water soluble sealant utilized to prevent the dry chemicals from being removed from the container during storage yet allowing condensate to be accumulated therein when the projections are disposed against a condensate accumulative surface.

9 Claims, 2 Drawing Figures

CLOG PREVENTING DEVICE FOR AIR CONDITIONING CONDENSATE DRAIN PANS

BACKGROUND OF THE INVENTION

This invention relates to a self-contained unit for use in preventing clogging in air conditioning condensate drain pans and in particular to a novel container cap for a container having anti-bacterial chemicals therein, the cap improving the diffusion of anti-bacterial chemicals into the drain pan to prevent slime accumulation thereon.

The overflow of water caused by clogged air conditioning condensate drains has been particularly problematical to users of individual air conditioning units, commercial air handlers, and centrally air conditioned buildings utilizing fan coil convectors. The large amount of bacteria which breeds in the condensate collects in the condensate drain pans and drain lines, a slime being formed, thereby restricting the drain-off. Because such drain pans are shallow due to space considerations, overflow of the drain pans often occurs, resulting in flooding.

Heretofore, clogging prevention has been achieved by utilizing packages having several tablets of various sizes formed of anti-bacterial chemicals disposed on a sponge bedding, the sponge bedding being utilized to provide a source of condensate wetting. A plastic envelope encapsulates the entire assembly, the envelope having a plurality of holes die cut therein to thereby allow water to be introduced into contact with the sponge bedding. The condensate in the sponge dissolves the tablet and diffuses the anti-bacterial chemicals into the main body of the pan water. Although such devices eliminates slime accumulation they have been less than completely satisfactory.

One problem with the tablets are their shape. Because the tablets are round, as the tablet dissolves, the rate of dissolve accelerates. This acceleration is particularly accentuated when the tablet package becomes immersed in the fluid. Accordingly, care has to be taken to raise the envelopes so that they are not totally submerged in the condensate pan thereby requiring additional structural elements to raise the tablets above the immersion level. Furthermore, the quick rate at which the tablets dissolves when totally submerged cause the tablets to be consumed quickly, thereby not providing protection after a short period of time. Moreover, although the tablets have to be raised so as not to be totally submerged in the water, the bottom of the envelope containing the tablets has to be resting in the condensate to maintain a chemical transfer, such positioning not being easily accomplished. Accordingly, in view of the above noted disadvantages of the prior art, a clog prevention device which is independent of the level of water and is able to evenly regulate the diffusion of the anti-bacterial chemicals into the condensate drain pan is particularly desired.

SUMMARY OF THE INVENTION

A container particularly adapted to prevent slime accumulation without regard to the level of condensate in the drain pan is provided. The container is adapted to introduce anti-bacterial chemical into condensate in contact therewith, and includes a container storing anti-bacterial chemicals, and a cap for closing the container. The cap defines a plurality of metering orifices, the metering orifices being adapted to control the diffusion rate of the anti-bacterial chemicals into the condensate. A plurality of projections are formed in the cap to space the metering orifices out of contact with the condensate drain pan's surface, the projections, solubility characteristics of the anti-bacterial chemicals and orifices effecting a capillary action to introduce the, anti-bacterial chemicals in the container into the condensate in a drain pan at a controlled rate.

A further feature of the unit is the inclusion of a water soluble sealant for preventing the dry anti-bacterial chemicals from escaping through the metering orifices during storage and transportation of the novel unit yet providing for the dissolving of same into the condensate drain pan when the unit metering orifices are placed in contact with the condensate.

Accordingly, it is an object of this invention to provide an improved unit for preventing slime accumulation in condensate drain pans.

Another object of this invention is to provide an improved container unit which evenly dissolves anti-bacterial chemicals into a condensate drain pan without regard to the level of condensate surrounding same.

Still another object of this invention is to provide an improved cap for unit wherein diffusion is induced between an outside liquid and a dry anti-bacterial chemical contained in the unit.

It is still a further object of this invention to provide a unit wherein the anti-bacterial chemicals stored therein remain sealed until the unit is activated by the placement thereof in a condensate drain pan.

Still other objects and advantages of the invention will in part be obvious and will in part be apparent from the specification.

The invention accordingly comprises the features of construction, combination of elements and arrangement of parts which will be exemplified in the construction hereinafter set forth and the scope of the invention will be indicated in the claims.

BRIEF DESCRIPTION OF THE DRAWINGS

For a fuller understanding of the invention reference is had to the following description taken in connection with the accompanying drawings, in which.

DETAILED DESCRIPTION OF THE PREFERRED EMBODIMENTS

Figure 1:
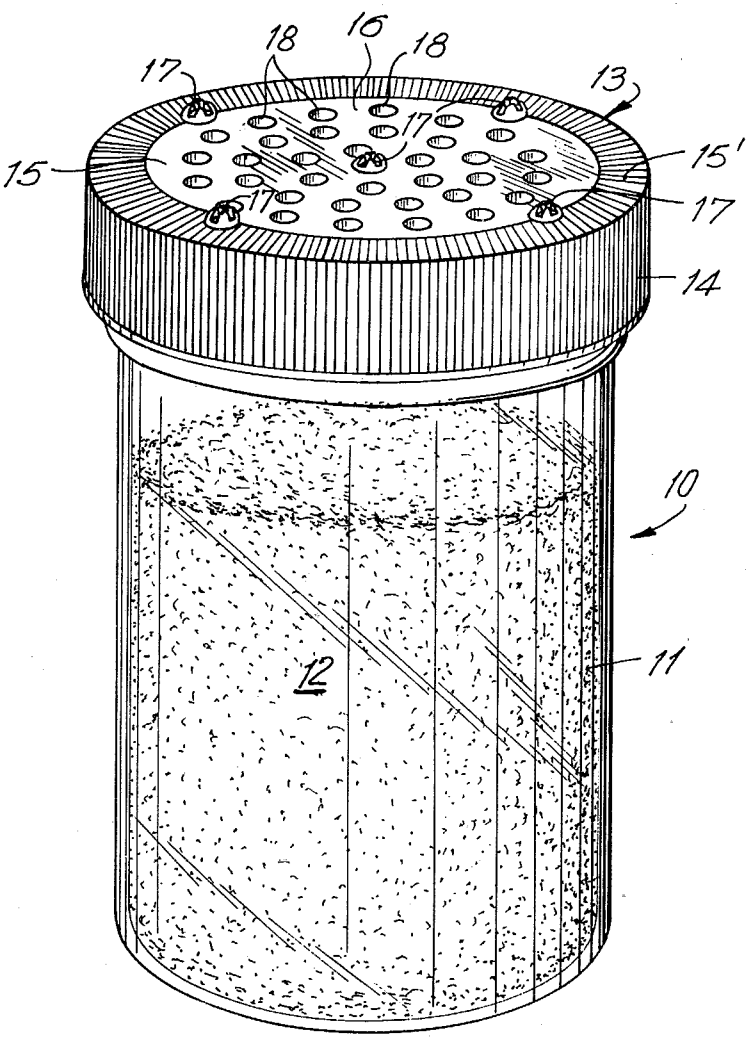
FIG. 1 is a perspective view of a unit constructed in accordance with the instant invention.

Referring now to FIG. 1, a unit, generally indicated at 10, is illustrated therein. The unit includes a container 11 having stored therein a dry anti-bacterial chemical, the composition of which will be hereinafter discussed. The container is closed by a cap generally indicated as 13, secured to the container 11.

Cap 13 is formed with a cylindrical side wall 14 and a closure wall 15. The closure wall 15 has an outer peripheral portion 15' including ridges which are continued from side wall 14 and a smooth inner surface 16. The ridges are provided for improving the gripping thereof to effect removal of the cap. Additionally, the inner side wall 14 of the cap is formed with threads which mate with threads formed in the upper portion of the container 11, to easily secure the cap to the container. Moreover, securing of the cap to the container in combination with a sealant hereinafter discussed, facilitates the storage and handling of the anti-bacterial chemical contained herein.

The cap 13 includes projections 17 intergrally molded into the top wall 15. As is clearly illustrated in FIG. 2, the projections space the surface 16 away from the drain pan surface 23 in contact with the projections. The surface 16 of top wall 15 defines metering orifices 18 therein, the number and size of the orifices being selected to utilize the surface tension between the condensate and the orifices to thereby utilize hydrostatic head to create a capillary action and thereby force the condensate through the orifices into contact with the chemical contents in the container.

It is noted that the projections 17 keep the metering orifices out of contact with the surface of the air conditioning condensate drain pan and that the height of the projections is significant. Although a range of 0.0625 inches to 0.25 inches is contemplated, the embodiment illustrated in FIG. 1 has a preferred height of 0.2 inches. At such a height, the projections 17 allow a laminar film of condensate to be formed beneath the cap 13 thereby permitting the capillary action in orifices 18, whereby condensate is drawn into the container. It is also noted that the number and size of the orifices is also selected to maintain the above noted surface tension and capillary action, to thereby support the flow of condensate into the body of the chemical. The number of orifices also controls the diffusion rate of chemical flow into the body of the pan condensate to insure a long service life.

The anti-bacterial chemical contained in the container 11 consists of 50% quaternary ammonium salt, preferably (98% C12, 2% C14) dimethyl 1-naphthylmethyl ammonium chloride monohydrate and 50% Sodium Borate Decahydrate (Borax) $Na_2B_4O_7$—10-$H_2O$. Quaternary ammonium is widely used as a biocide, disinfectant and sterlizer and its end use determines the concentration in the various formulae. As is explained in greater detail below, the quaternary amonium salt is a difficultly-soluble compound and the Sodium Borate Decahydrate is a readily soluble salt, the respective solubility characteristics of the compounds forming the anti-bacterial chemical in combination with the orifices in the cap contributing to the rate at which the biocide is introduced into the condensate.

Also, a sealant layer 25 formed of hydroxypropylmethyl cellulose, for instance Methocel 60 HG manufactured by Dow Chemical Company, is provided in the cap for sealing the orifices 18, to thereby eliminate the loss of the dry anti-bacterial chemical through the orifices during shipping and storage. The sealant is soluble in water and allows for viscosity control by controlling the chain length or degree of polymerization of the cellulose molecule. Accordingly, the sealant forms a soluble skin between the holes and the chemical contents so that the placement of the cap into the condensate renders the sealant soluble and allows fluid communication between the condensate without the cap and the dry anti-bacterial chemical within the container.

Figure 2:
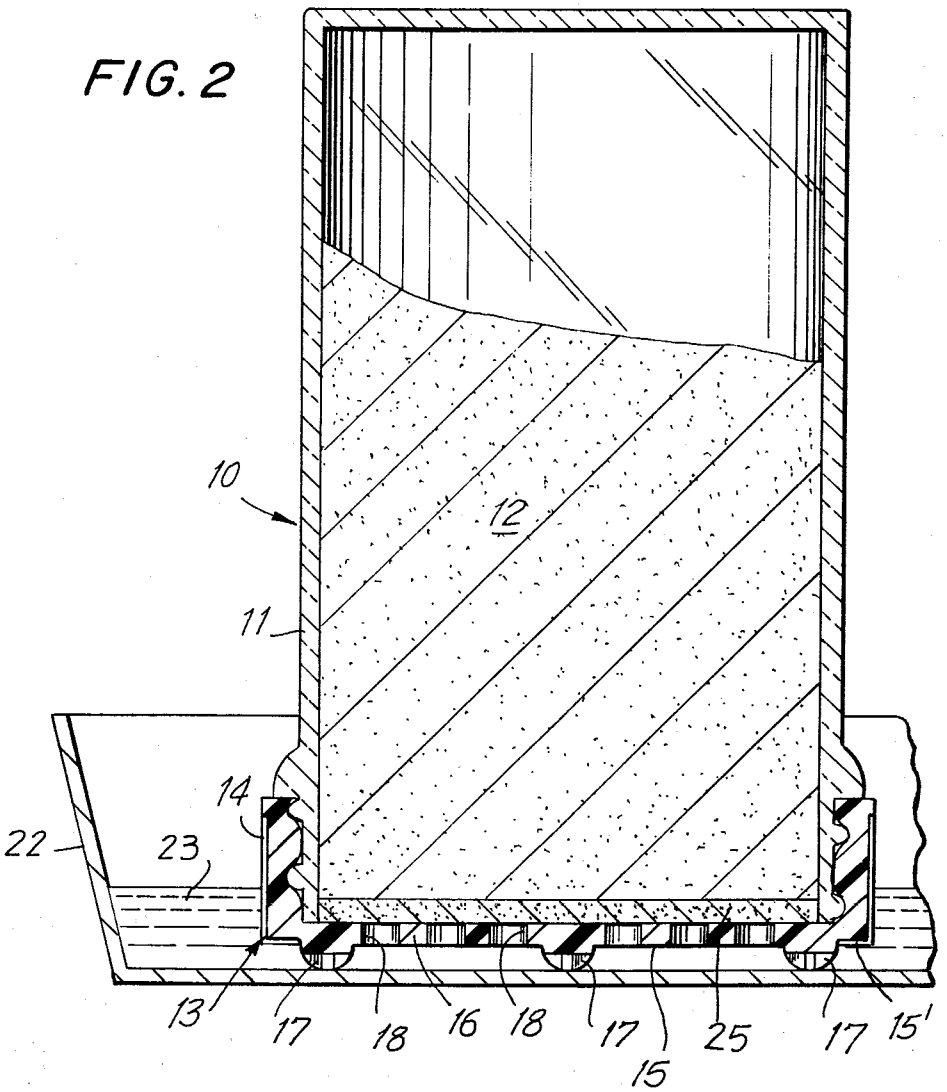
FIG. 2 is a sectional view of the unit illustrated in FIG. 1, operatively disposed in a condensate drain pan.

Specific reference is made to FIG. 2 wherein the operation of the unit is illustrated. The unit is placed in a condensate drain pan 22 having condensate 23 therein. The projections 17 of the unit are rested against the bottom surface of the drain pan 22. Because the height of the projections 17 is selected to allow a laminar film of water to be contained between the cap surface 16 and the drain pan 22, and further, because the size of the orifices 18 are selected to establish and maintain surface tension, capillary action and hydrostatic head effects a flow of condensate through orifices 18 into contact with the sealant layer inside the unit. The condensate will dissolve the sealant layer and contact the dry anti-bacterial chemical. Accordingly, the water is drawn into the device by the combined effect of the projections provided for establishing clearance for providing a laminar film of water between the surface 16 permits water to flow upward through the orifices as a result of surface tension and hydrostatic head into contact with the anti-bacterial chemical. When the condensate contacts the dry anti-bacterial chemicals, the anti-bacterial chemicals proceed to dissolve and diffuse through the regions of high concentration within the container and out through the orifices and into the regions of low concentration below and around the container thereby establishing the desired concentration level within the condensate in the drain pan. Accordingly, by utilizing the physical principles of hydrostatic head, capillary action, laminar flow, convection, surface tension and diffusion, a concentration difference is created between the dissolved anti-bacterial chemicals and the condensate in the drain pan. Moreover, because of the physical principle of rate flow, the entire process by which the anti-bacterial chemical is transferred from the container to the drain pan is controlled and such control in no way depends on the level of the condensate in the drain pan. Moreover, the number of orifices is selected to insure a controlled dissolution rate of chemical flow into the drain pan to thereby insure an even metering effect to thereby guarantee that the anti-bacterial chemical will be utilized over a long period of time.

As noted above, the projections provided for establishing clearance provide a layer of fluid at the surface, the layer being in laminar flow. The condensate rises through the orifices as a result of hydrostatic head and comes into contact with the anti-bacterial chemical. The readily soluble Sodium Borate Decahydrate compound is dissolved at a faster rate than the difficultly-soluble quaternary amonium biocide compound, and thereby forms pores and channels within the powdered antibacterial composition. The pores and channels in the composition caused by the dissolving of the readily soluble compound increases the region of contact between the condensate and the biocide compound and thereby increases the rate of dissolution of the difficultly-soluble biocide compound. The biocide compound is then transferred through the orifices to the flowing condensate exterior to the canister by diffusion. Thus, if the flow of condensate in the drain pan increases, by the physical principle of hydrostatic head, more condensate will enter the container through the orifices and cause a greater amount of biocide compound to be dissolved into the condensate in the drain pan. Conversely, if the flow of condensate in the drain pan is low, very little condensate will enter into the orifices of the container, and the amount of difficultly-soluble biocide compound to be dissolved into the drain pan is reduced. Accordingly, the respective solubility characteristics of the compounds forming the anti-bacterial composition, in combination with the orifices and projections formed in the cap effect a metering of the biocide compound into the drain pan in direct relationship to the flow of condensate in the drain pan.

It will thus be seen that the objects set forth above, amount those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A clog preventing device comprising a container having an anti-bacterial composition therein, said anti-bacterial composition being comprised of a first low soluble anti-bacterial compound and a second readily soluble compound having a higher solubility than said low soluble antibacterial compound, both said compounds being intermixed in powder form, said container being closed by a cap and having metering orifices therein and projections disposed thereon, said projections being constructed and arranged to space said metering orifices out of contact with a condensate accumulative surface to allow condensate to enter through said orifices into said container to dissolve the respective compounds forming said anti-bacterial composition contained therein at different rates determined by their solubility characteristics, the metering orifices and solubility characteristic of the said second soluble compound forming the anti-bacterial composition controlling the rate of diffusion of the first low soluble compound into the condensate to kill bacteria in the condensate and thereby prevent slime accumulation.

2. A clog preventing device as claimed in claim 1, wherein low soluble anti-bacterial compound is a quaternary ammonium compound.

3. A clog preventing device as claimed in claim 2, wherein said second readily soluble compound is a salt.

4. A clog preventing device as claimed in claim 3, wherein said second readily soluble compound is Borax.

5. A clog preventing device as claimed in claim 2, wherein said projections disposed on said cap are of equal length to guarantee a specific spacing of the orifices from a surface in contact with the projections to provide a laminar layer of condensate between said orifices and the condensate accumulative surface.

6. A clog preventing device as claimed in claim 5, wherein the length of said projections is between 0.0625 and 0.25 inches.

7. A clog preventing device as claimed in claim 5, wherein the number of orifices is selected to control the diffusion rate of chemical flow into the condensate.

8. A clog preventing device as claimed in claim 2, wherein said antibacterial quaternary ammonium compound consists of quaternary ammonium, N-ALKYL and dymethyl L-naphthylmethyl ammonium chloride monohydrate.

9. A clog preventing device as claimed in claim 8, wherein said container includes a sealant constructed and arranged so as to seal the orifices and thereby prevent loss of the dry intermixed powder chemicals contained therein, said sealant being water soluble.

* * * * *